US006010367A

United States Patent [19]

Wu

[11] Patent Number: 6,010,367

[45] Date of Patent: Jan. 4, 2000

[54] ELECTRICAL CONNECTOR HAVING MODULAR COMPONENTS

[75] Inventor: Kun-Tsan Wu, Tu-Chen, Taiwan

[73] Assignee: Hon Hai Pre Cision Ind. Co., Ltd., Taipei Hsien, Taiwan

[21] Appl. No.: 09/336,183

[22] Filed: Jun. 18, 1999

[51] Int. Cl.[7] ..... H01R 13/66

[52] U.S. Cl. ..... 439/620; 439/676

[58] Field of Search ..... 439/620, 676, 439/941, 607

[56] References Cited

U.S. PATENT DOCUMENTS

| | | | |
|---|---|---|---|
| 5,069,641 | 12/1991 | Sakamoto et al. | 439/620 |
| 5,587,884 | 12/1996 | Raman | 439/620 |
| 5,647,767 | 7/1997 | Scheer et al. | 439/620 |
| 5,687,233 | 11/1997 | Loudermilk et al. | 439/620 |
| 5,736,910 | 4/1998 | Townsend et al. | 439/620 |
| 5,759,067 | 6/1998 | Scheer | 439/620 |

*Primary Examiner*—Gary F. Paumen
*Attorney, Agent, or Firm*—Wei Te Chung

[57] ABSTRACT

An electrical connector comprises a housing defining a mating opening for receiving a mating connector. A first terminal module includes a first insert molded member receiving a number of first terminals therein. A second terminal module includes a second insert molded member receiving a number of second terminals therein. An electronic element attached to a top surface of the housing. The housing further includes a shielding device having first and second shells assembled thereto. The first and second terminal modules are assembled to the housing in a direction perpendicular to the mating opening of the housing thereby facilitating assembly of the connector.

16 Claims, 4 Drawing Sheets

ELECTRICAL CONNECTOR HAVING MODULAR COMPONENTS

BACKGROUND OF THE INVENTION

The present invention relates to an electrical connector, and particularly to an electrical connector comprising terminal modules and a modular electronic device for facilitating assembly.

As technology progresses, computers along with many other electrical communication network products have become an essential part of contemporary life. Manufacturers strive to create high quality products which meet the strict demands of the market. Referring to U.S. Pat. Nos. 5,069,641; 5,647,767; and 5,587,884, conventional electrical connectors used for network communications commonly adopt an electrical element, such as a noise suppressing electronic element, signal conditioning components, or a component printed circuit board, for ensuring proper signal transmission therethrough. However, the conventional connectors include too much additional components, flrthermore, the manufacture and assembly of the conventional connector is complex and laborious thereby increasing costs.

BRIEF SUMMARY OF THE INVENTION

An object of the present invention is to provide an electrical connector having terminal modules assembled to a housing in a direction perpendicular to a mating opening of the housing thereby facilitating the assembly process thereof.

Another object of the present invention is to provide an electrical connector having an electronic element fixed on a housing for simplifying manufacture and decreasing costs.

A further object of the present invention is to provide an electrical connector having a shielding device comprising two shells for enclosing the connector, the shells respectively forming grounding arms and legs thereby providing excellent shielding and grounding effects.

A connector in accordance with the present invention has terminal modules assembled to a housing thereof in a direction perpendicular to a mating opening of the housing. Each component of the connector is disposed according to practical requirements. Thus, the connector is compact and stable, and the assembly process thereof is quick and convenient.

The housing has a front surface having a mating opening defined therein the front surface further defines a cutout exposed to the mating opening for receiving a terminal module therein. A second receiving space is defined in a rear surface of the housing for receiving a second terminal module. A first receiving slot is defined in the top surface of the housing. The first and second terminal modules each have a plurality of terminals received in corresponding first and second insert molded members, and are partially assembled to an electronic element as a unit in the same direction. The connector further comprises a shielding device consisting of a first shell and a second shell. The first shell defines a pair of grounding arms for providing the connector with excellent shielding and grounding effects.

Other objects, advantages and novel features of the invention will become more apparent from the following detailed description when taken in conjunction with the accompanying drawings.

DETAILED DESCRIPTION OF THE INVENTION

Figure 1:
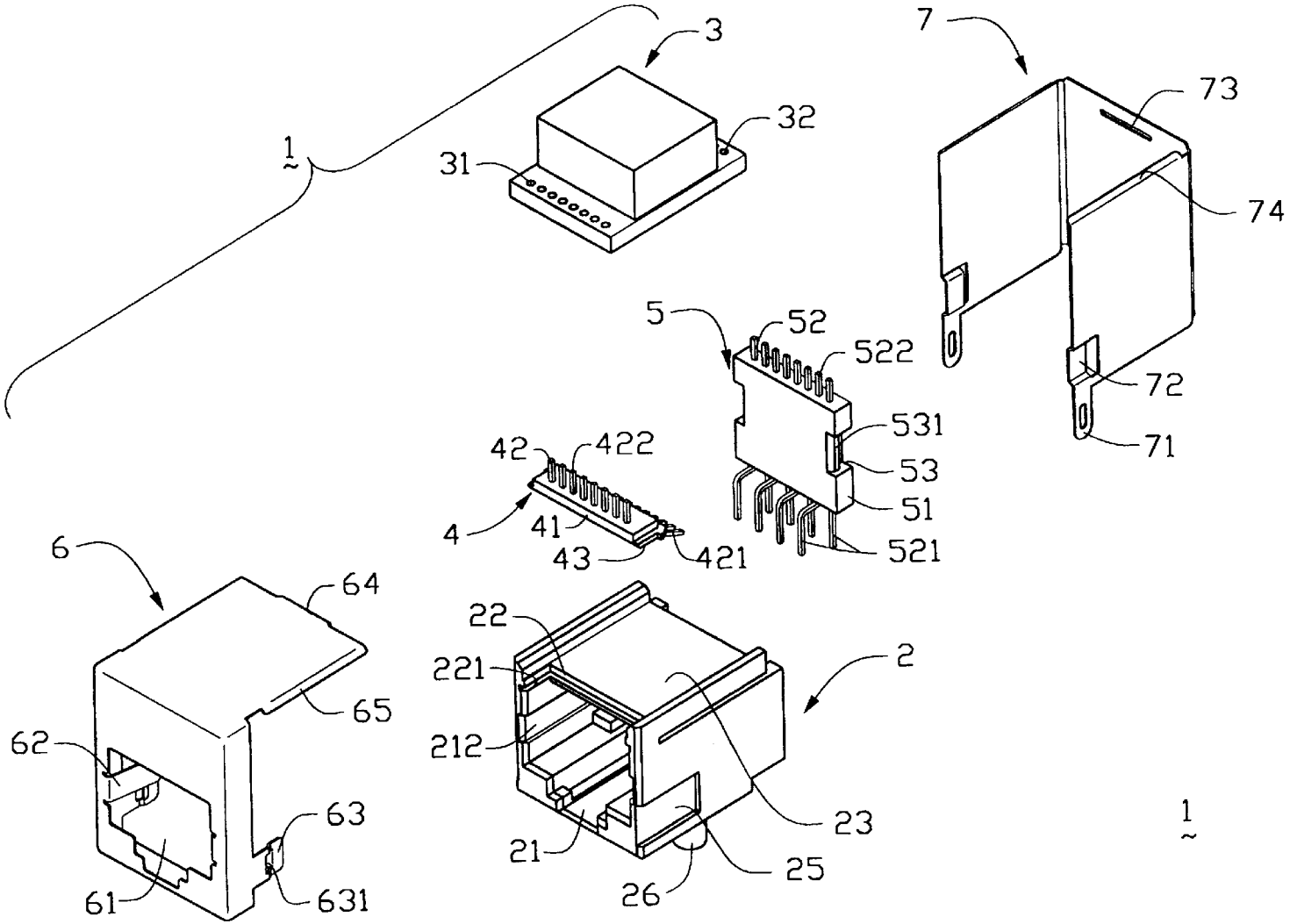
FIG. 1 is an exploded view of a connector in accordance with the present invention.
Figure 2:
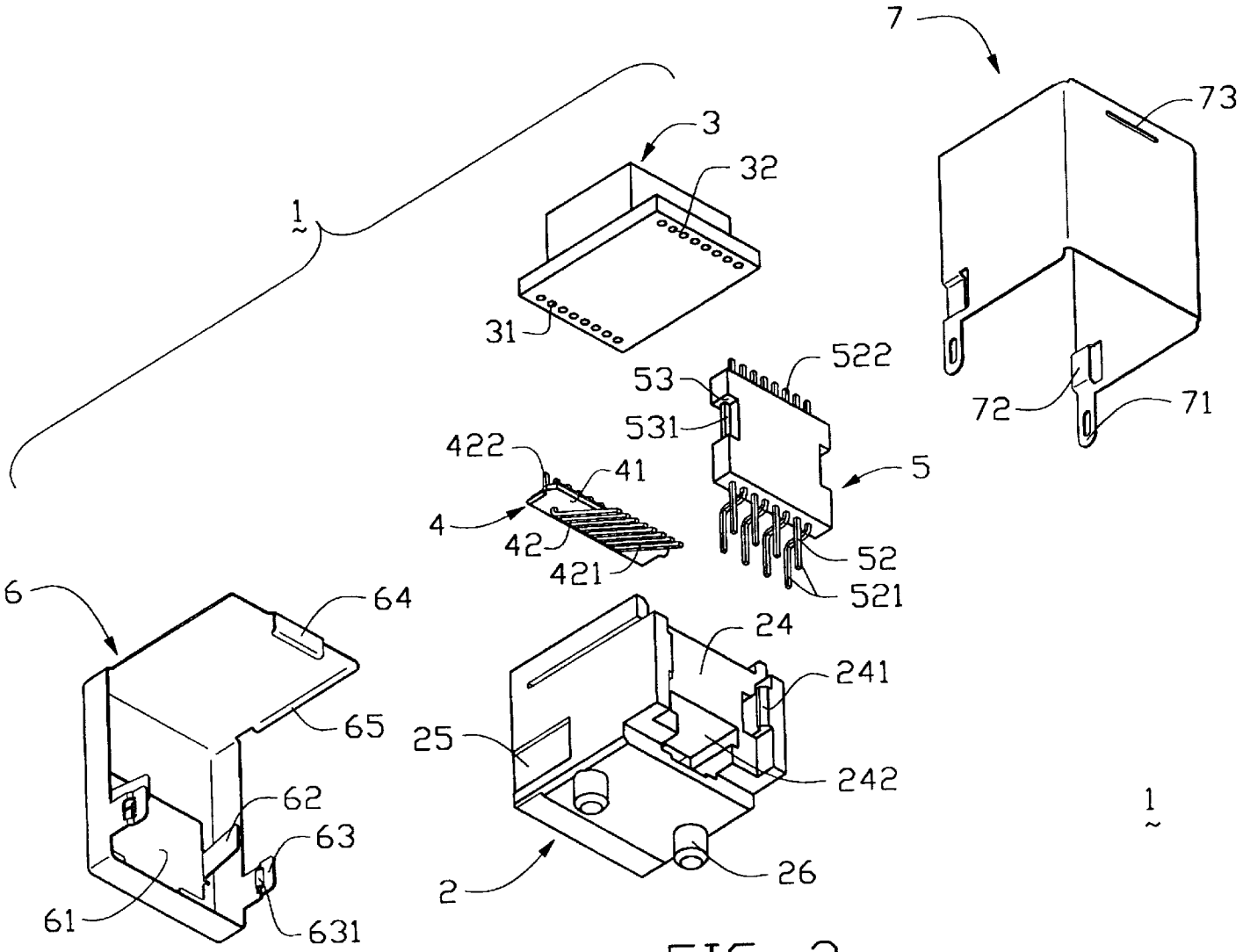
FIG. 2 is an exploded view of the present invention taken from a different perspective view from FIG. 1.

Referring to FIGS. 1 and 2, an electrical connector 1 in accordance with the present invention comprises a housing 2, an electronic element 3, a first terminal module 4, a second terminal module 5 and a shielding device (not numbered). The housing 2 has a cubicle shape. A mating opening 21 is defined in a front surface of the housing 2 and a pair of grooves 212 is defined in opposite inner side surfaces communicating with the mating opening 21. A cutout 22 is formed in a top surface of the housing 2 and is exposed to the mating opening 21 for receiving the first terminals module 4 therein. A notch 221 is defined along a periphery of the cutout 22. A first receiving slot 23 is formed above the top surface of the housing 2 between the side surfaces. A second receiving slot 24 is formed in a rear surface of the housing 2 between the side surfaces for receiving the second terminal module 5. A pair of protrusions 241 extend from the side surfaces into the second receiving slot 24. A channel 242 is defined in the rear surface of the housing 2 in communication with the mating opening 21. A pair of posts 26 downwardly extend from the housing 2 for engaging to a mating circuit board (not shown).

The first terminal module 4 comprises a first insert molded member 41 and a plurality of first terminals 42 received therein. Each first terminal 42 has a contact end 421 and a joint end 422. The contact end 421 extends from one surface of the first insert molded member 41 and is bent an appropriate angle for electrically contacting a mating connector. The joint end 422 outwardly extends from the other surface of the first insert molded member 41 for electrically connecting with the electronic element 3. A flange 43 is formed along a periphery of the first insert molded member 41 for mating with the notch 221 of the housing 2. Thus, the first terminal module 4 is received in the cutout 22 and the contact ends 421 of the first terminals 42 extend through the mating opening 21 in the housing 2.

The second terminal module 5 comprises a second insert molded member 51 and a plurality of second terminals 52. Each second terminal 52 has a contact end 521 extending from one surface of the second insert molded member 51 for electrically contacting with a mating circuit board, and a joint end 522 extending from the other surface of the second insert molded member 51 for electrically contacting with the electronic element 3. Alternately contact ends 521 of the second terminals 52 are bent an appropriate angle and then extend parallel to the contact ends 521 of the second terminals 52 which are not bent for being received in the channel 242. A pair of cutouts 53 are disposed in opposite side walls of the second insert molded member 51. A projecting block 531 is formed defined in each cutout 53 for interferentially fitting with the protrusions 241 of the housing 2. Thus, the second terminal module 5 is fixed to the housing 2.

The electronic element 3 defines first holes 31 and second holes 32 in opposite sides thereof for receiving the corresponding joint ends 422, 522 of the first terminal module 4 and the second module 5, respectively, when the electronic element 3 is received in the first receiving slot 23.

The shielding device encloses the connector 1 and comprises a first shell 6 and a second shell 7. The first shell 6 is L-shaped and defines an opening 61 in a front surface thereof corresponding to the mating opening 21 of the housing 2 for receiving a mating connector therein. A pair of grounding arms 62 inwardly extend from opposite inner edges of the opening 61 for being received in the corresponding grooves 212 of the housing 2. A pair of securing sections 63 outwardly extend from opposite outer sides of the front surface of the first shell 6. Each securing section 63 forms an outwardly resilient clasp 631 for engaging with the second shell 7. A securing tab 64 downwardly extends from an edge of a top surface of the first shell 6. A pair of first flanges 65 downwardly extend from opposite edges of the top surface of the first shell 6.

The second shell 7 is U-shaped and forms a pair of cavities 72 on opposite surfaces thereof for abutting against the corresponding recesses 25 of the housing 2 and interferentially receiving the corresponding clasp 631 of the first shell 6. A pair of grounding legs 71 downwardly extend from the opposite surfaces of the second shell 7 proximate the cavities 72 for being fixed to a mating circuit board (not shown). An aperture 73 is defined in a rear surface of the second shell 7 for receiving the securing tab 64 of the first shell 6. A pair of inwardly extending second flanges 74 are formed on top edges of the opposite side surfaces of the second shell 7 for interferentially abutting against the flanges 65 of the first shell 6 thereby completing assembly of the shielding device.

Figure 3:
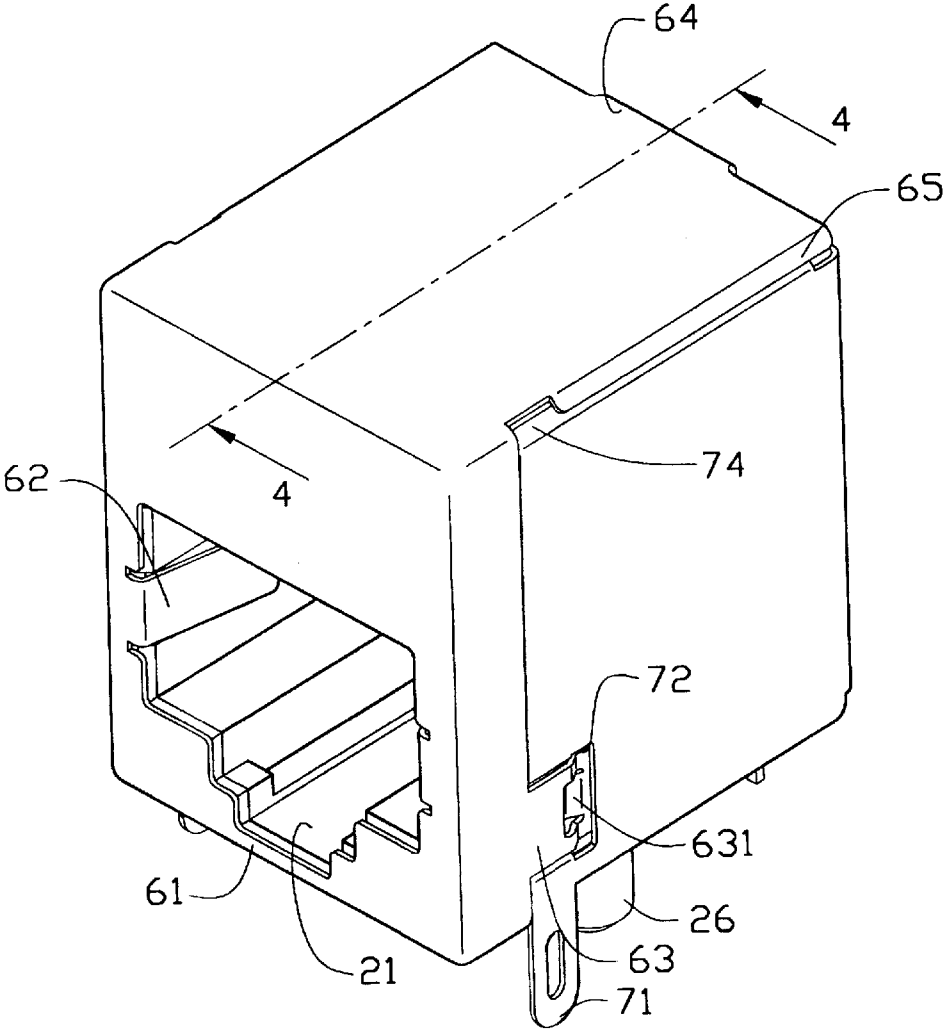
FIG. 3 is an assembled view of FIG. 1.
Figure 4:
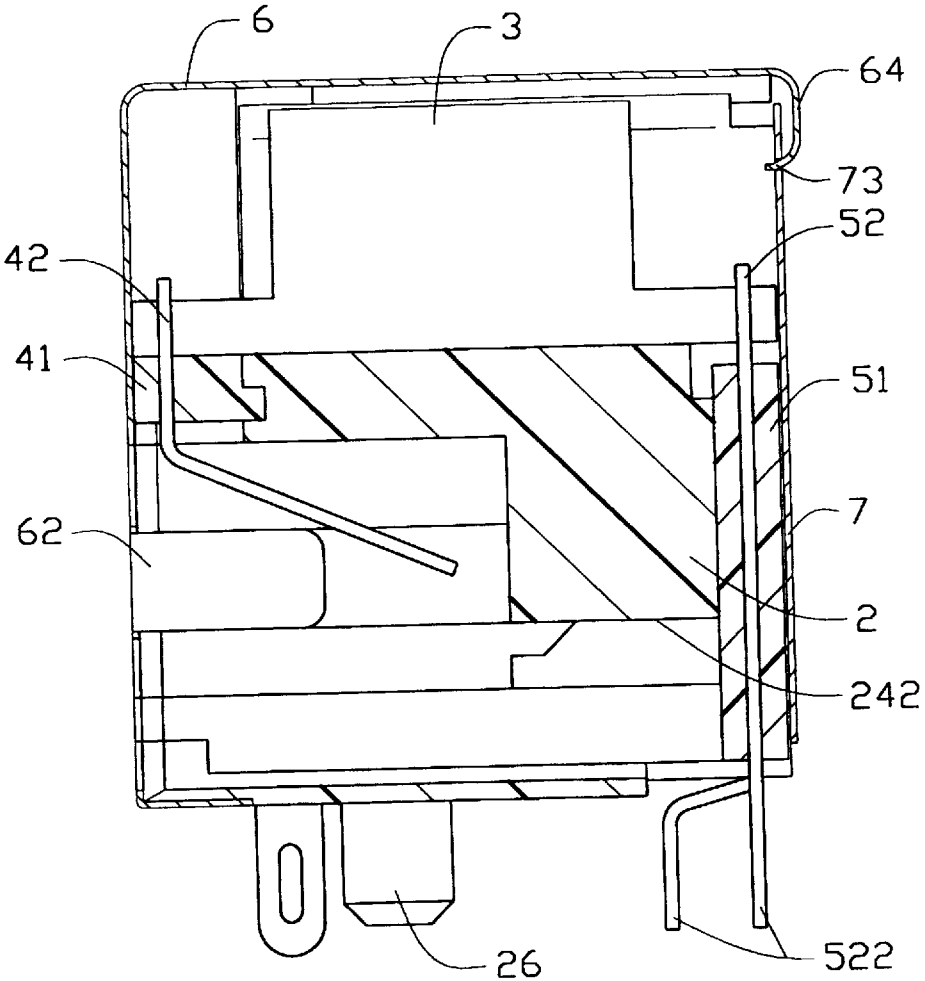
FIG. 4 is cross-sectional view taken along line 4—4 of FIG. 3.

Also referring to FIGS. 3 and 4, during assembly of the connector 1, the first terminal module 4 and the second terminal module 5 are inserted into the cutout 22 and the second receiving slot 24, respectively. The electronic element 3 is received in the first receiving slot 23, and the joint ends 422, 522 of the first terminals 42 and the second terminals 52 extend through the corresponding first holes 31 and second holes 32 of the electronic element 3, respectively. Lastly, the first and second shells 6, 7 of the shielding device are attached to the housing 2 and fixed together thereby completing assembly of the connector 1.

The terminals 42, 52 of the connector 1 are modular, and the first and second terminal modules 4, 5 are assembled in a direction perpendicular to the mating opening 21 of the housing 2 for facilitating assembly of the connector 1 and decreasing costs. Positions of components of the connector 1 are selected according to practical requirements thereby enabling the connector 1 to be quickly and steadily assembled by eliminating unnecessary procedures.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

a housing defining a mating opening in a front surface thereof for receiving a mating connector, a first receiving slot defined a top surface thereof, a second slot defined a rear surface thereof, and a cutout defined in the top surface of the housing and exposed to the mating opening;

a first terminal module and a second terminal module received in the cutout and the second receiving slot, respectively; and an electronic device received in the first receiving slot and electrically connected with the first and the second terminal modules.

2. The electrical connector as claimed in claim 1, wherein the housing has a pair of protrusions inwardly projecting from opposite sides of the second receiving slot.

3. The electrical connector as claimed in claim 2, wherein the cutout of the housing defines a notch along a periphery thereof.

4. The electrical connector as claimed in claim 3, wherein the first terminal module comprises a first insert molded member receiving a plurality of first terminals therein.

5. The electrical connector as claimed in claim 4, wherein the first insert molded member forms a flange along a periphery thereof for being interferentially received in the notch of the housing.

6. The electrical connector as claimed in claim 5, wherein each first terminal comprises a contact end and a joint end, the contact end outwardly extending from one surface of the first insert molded member and being bent an appropriate angle for electrically contacting with a mating connector, the joint end extending from the opposite surface of the first insert molded member for electrically contacting with the electrical device.

7. The electrical connector as claimed in claim 4, wherein the second terminal module comprises a second insert molded member receiving a plurality of second terminals therein.

8. The electrical connector as claimed in claim 7, wherein a pair of cutouts is defined in opposite side walls of the second insert molded member, a projecting block extending into each cutout for interferentially fitting with the corresponding protrusion of the housing.

9. The electrical connector as claimed in claim 8, wherein each second terminal comprises a contact end and a joint end, the joint end outwardly extending from one surface of the second insert molded member for electrically contacting with the electrical device, the contact end extending from the opposite surface of the second insert molded member, the contact ends being separated into two rows for electrically connecting with a mating circuit board.

10. The electrical connector as claimed in claim 1, wherein the housing defines a pair of recesses in the outer surfaces of two opposite side walls adjacent to the mating opening and a pair of grooves being defined in the inner surfaces of the two opposite side walls.

11. The electrical connector as claimed in claim 10 further comprising a shielding device for enclosing the connector.

12. The electrical connector as claimed in claim 11, wherein the shielding device comprises a first shell and a second shell.

13. The electrical connector as claimed in claim 12, wherein the first shell is L-shaped and defines an opening corresponding to the mating opening of the housing, a pair of grounding arms inwardly extending from opposite inner edges of the opening for being received in the corresponding grooves of the housing, a pair of securing sections outwardly extending from opposite outer sides of the first shell, a pair of resilient clasps outwardly extending from the securing sections for engaging with the second shell, a securing arm downwardly extending from an edge of a top surface of the first shell, and a pair of first flanges downwardly extending from opposite edges of the top surface of the first shell.

14. The electrical connector as claimed in claim 12, wherein the second shell is U-shaped and comprises a pair of cavities being defined in opposite surfaces thereof for abutting against the corresponding recesses of the housing and interferentially receiving the corresponding securing clasp of the first shell, a pair of grounding legs downwardly extending from the cavities for being fixed to a mating circuit board, an aperture defined in a rear surface of the second shell for receiving the securing tab of the first shell, and a pair of inwardly extending second flanges formed on top edges of opposite side surfaces of the second shell for interferentially abutting against the first flanges of the first shell.

15. The electrical connector as claimed in claim 1, wherein the electronic device is an electronic element.

16. An electrical connector comprising:

a housing defining a mating opening in a front face thereof;

an electronic device positioned outside of the housing;

a first group of terminals each including a first end extending into the mating opening and a second end connected to one side of said electronic device;

a second group of terminals each including a first end connected to another side of said electronic device and a second end downward extending for mounting to a circuit board on which the connector is mounted; and a shielding assembly defining a space which is substantially significantly larger than the housing, and thus receiving both the housing and the electronic device therein;

wherein said electronic device is positioned on the top of the housing, and the second end of each of the first group of terminals and the first end of each of the second group of terminals extend upward parallel to each other.

* * * * *